US010351219B1

(12) United States Patent
Haynes et al.

(10) Patent No.: US 10,351,219 B1
(45) Date of Patent: Jul. 16, 2019

(54) LIFE RAFT SYSTEM WITH MULTIPURPOSE INFLATABLE BOARDING DECK

(71) Applicant: GOODRICH CORPORATION, Charlotte, NC (US)

(72) Inventors: Timothy C. Haynes, Prescott Valley, AZ (US); Michael A. Luzader, Laveen, AZ (US)

(73) Assignee: Goodrich Corporation, Charlotte, NC (US)

( * ) Notice: Subject to any disclaimer, the term of this patent is extended or adjusted under 35 U.S.C. 154(b) by 0 days.

(21) Appl. No.: 15/910,595

(22) Filed: Mar. 2, 2018

(51) Int. Cl.
*B63B 35/58* (2006.01)
*B63C 9/04* (2006.01)
*B63B 27/00* (2006.01)

(52) U.S. Cl.
CPC ..... *B63C 9/04* (2013.01); *B63B 27/00* (2013.01); *B63C 2009/042* (2013.01); *B63C 2009/044* (2013.01)

(58) Field of Classification Search
CPC . B63C 9/04; B63C 2009/04; B63C 2009/042; B63C 2009/044; B63B 27/00; B63B 27/02; B63B 27/14; B63B 27/143; B63B 2027/00; B63B 2027/02; B63B 2027/14; B63B 2027/143
USPC ..... 441/35, 38, 39, 40, 41; 114/362, 364
See application file for complete search history.

(56) References Cited

U.S. PATENT DOCUMENTS

| | | | | |
|---|---|---|---|---|
| 2,914,779 | A * | 12/1959 | Walker | B63C 9/02 441/39 |
| 3,034,154 | A * | 5/1962 | Silverstone | B63C 9/02 244/905 |
| 3,037,218 | A * | 6/1962 | Brooks, III | B63C 9/02 244/905 |
| 4,001,905 | A * | 1/1977 | Givens | B63C 9/06 114/125 |
| 4,678,443 | A | 7/1987 | Edwards et al. | |
| 4,723,929 | A | 2/1988 | Parish | |
| 4,828,520 | A * | 5/1989 | Baughman | B63C 9/04 114/345 |
| 7,357,688 | B2 * | 4/2008 | Ferrara | B63B 7/082 114/345 |
| 8,382,541 | B1 | 2/2013 | Campbell | |

FOREIGN PATENT DOCUMENTS

| | | |
|---|---|---|
| WO | 1996022913 | 8/1996 |
| WO | 1999042359 | 8/1999 |

* cited by examiner

*Primary Examiner* — Daniel V Venne
(74) *Attorney, Agent, or Firm* — Snell & Wilmer, L.L.P.

(57) ABSTRACT

A life raft may comprise a base and a multipurpose inflatable boarding deck coupled to the base and moveable between a first position whereby the multipurpose inflatable boarding deck facilitates embarking and a second position whereby the multipurpose inflatable boarding deck supports a canopy.

19 Claims, 6 Drawing Sheets

LIFE RAFT SYSTEM WITH MULTIPURPOSE INFLATABLE BOARDING DECK

FIELD

The present disclosure relates to aircraft evacuation assemblies, and more specifically to a life raft.

BACKGROUND

In the event of an emergency water landing, aircraft typically have one or more life rafts that can be deployed to hold evacuated passengers. Conventional rafts may be either deployed in a specific orientation to prevent inflation in an inverted position or may be able to be manually righted after an inverted deployment.

SUMMARY

A life raft is disclosed, comprising a base comprising a first side and a second side, and a multipurpose inflatable boarding deck coupled to the base and moveable between a first position whereby the multipurpose inflatable boarding deck facilitates embarking and a second position whereby the multipurpose inflatable boarding deck supports a canopy.

In various embodiments, the base comprises an inflatable border tube defining a first inflatable volume.

In various embodiments, the multipurpose inflatable boarding deck defines a second inflatable volume, and the first inflatable volume is in fluidic communication with the second inflatable volume.

In various embodiments, the life raft further comprises an inflation port, whereby the multipurpose inflatable boarding deck is coupled to the inflatable border tube.

In various embodiments, the inflation port bends in response to the multipurpose inflatable boarding deck moving to the second position.

In various embodiments, the multipurpose inflatable boarding deck comprises an inflatable tube, and a platform supported by the inflatable tube.

In various embodiments, the multipurpose inflatable boarding deck comprises a first inflatable tube extending from the inflatable border tube, a second inflatable tube extending from the inflatable border tube, and a platform supported by the first inflatable tube and the second inflatable tube.

In various embodiments, the life raft further comprises a fastening feature configured to secure the multipurpose inflatable boarding deck in the second position.

In various embodiments, the fastening feature extends between the base and the multipurpose inflatable boarding deck in response to the multipurpose inflatable boarding deck being in the second position.

A life raft is disclosed, comprising a base comprising a first inflatable border tube defining a first inflatable volume, the base comprising a first side and a second side, and a first multipurpose inflatable boarding deck defining a second inflatable volume, the first multipurpose inflatable boarding deck coupled to the base and moveable between a first position whereby the first multipurpose inflatable boarding deck facilitates embarking and a second position whereby the first multipurpose inflatable boarding deck supports a canopy, wherein the first inflatable volume is in fluidic communication with the second inflatable volume.

In various embodiments, the life raft further comprises a second multipurpose inflatable boarding deck.

In various embodiments, the life raft further comprises a second inflatable border tube, wherein the second multipurpose inflatable boarding deck is coupled to the second inflatable border tube.

In various embodiments, the life raft further comprises the canopy, wherein the canopy is configured to extend between the first multipurpose inflatable boarding deck and the second multipurpose inflatable boarding deck in response to the first multipurpose inflatable boarding deck and the second multipurpose inflatable boarding deck being in the second position.

In various embodiments, the first multipurpose inflatable boarding deck comprises an inflatable tube, a platform supported by the inflatable tube, and an inflation port whereby the inflatable tube is coupled to the first inflatable border tube, wherein the inflation port is configured to bend in response to the first multipurpose inflatable boarding deck moving to the second position.

In various embodiments, the first multipurpose inflatable boarding deck comprises a first inflatable tube extending from the first inflatable border tube, a second inflatable tube extending from the first inflatable border tube, and a platform supported by the first inflatable tube and the second inflatable tube.

In various embodiments, the life raft further comprises a fastening feature configured to secure the first multipurpose inflatable boarding deck in the second position.

In various embodiments, the fastening feature extends between the base and the first multipurpose inflatable boarding deck in response to the first multipurpose inflatable boarding deck being in the second position.

A method of using a life raft is disclosed, comprising rotating a multipurpose inflatable boarding deck about a base of the life raft from a first position to a second position, and securing the multipurpose inflatable boarding deck to the life raft in the second position.

In various embodiments, the multipurpose inflatable boarding deck facilitates embarking in the first position, and the multipurpose inflatable boarding deck supports a canopy in the second position.

In various embodiments, the base comprises an inflatable border tube defining a first inflatable volume, the multipurpose inflatable boarding deck defines a second inflatable volume, and the first inflatable volume is in fluidic communication with the second inflatable volume.

The forgoing features and elements may be combined in various combinations without exclusivity, unless expressly indicated herein otherwise. These features and elements as well as the operation of the disclosed embodiments will become more apparent in light of the following description and accompanying drawings.

Figure 1:
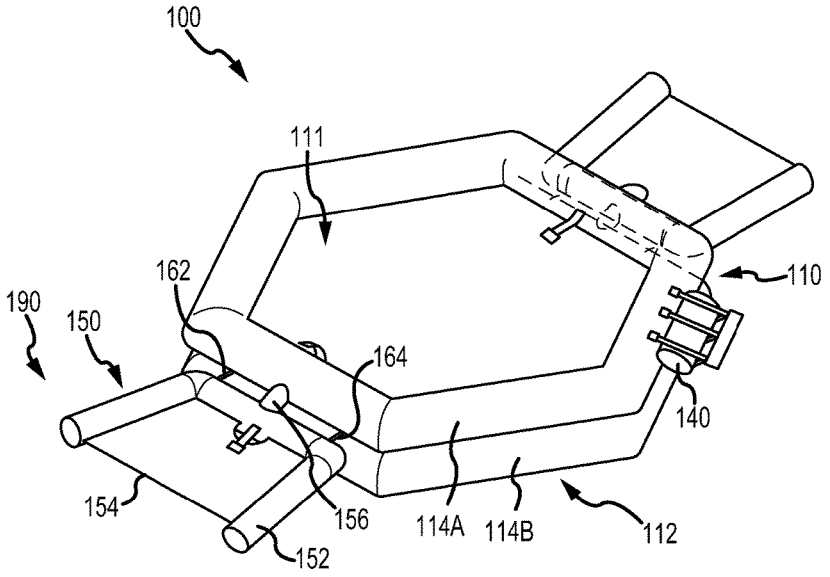
FIG. 1 is a perspective view of a life raft with a multipurpose inflatable boarding deck in a boarding position, in accordance with various embodiments.

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the disclosures, it should be understood that other embodiments may be realized and that logical changes and adaptations in design and construction may be made in accordance with this disclosure and the teachings herein. Thus, the detailed description herein is presented for purposes of illustration only and not of limitation. Throughout the present disclosure, like reference numbers denote like elements. Accordingly, elements with like element numbering may be shown in the figures but may not be necessarily be repeated herein for the sake of clarity.

In the event of an emergency water landing, aircraft typically have one or more life rafts that can be deployed to hold evacuated passengers. In various embodiments, and with reference to FIG. 1, the present disclosure provides a life raft 100 that includes a multipurpose inflatable boarding deck 150 that can be used as both a boarding deck and a canopy support. That is, in various embodiments, the multipurpose inflatable boarding deck 150 may be moved between a first position, where it may be used as a boarding deck for facilitating passengers embarking the life raft 100, and a second position, where it may be used to support a canopy, as described in greater detail below. Accordingly, the life raft 100 may be utilized and deployed without stand-alone canopy support structure on both sides of the life raft, thereby decreasing the complexity of the life raft, decreasing the weight of the life raft, and decreasing the cost of the life raft, according to various embodiments.

In various embodiments, and with reference to FIG. 1, life raft 100 generally includes a base 110, and the multipurpose inflatable boarding deck 150. The base 110 has a first side 111 and a second side 112 opposite the first side 111. In various embodiments, the first side 111 or the second side 112 of the base 110 of the life raft 100 may be a top surface of the life raft 100 upon which passengers are supported in response to the life raft 100 being deployed in water. That is, the base 110 of the life raft 100 may be inflatable, and the base 110 may include one or more inflatable border tubes 114A, 114B. The first and second inflatable border tubes 114A, 114B may provide buoyancy to the life raft 100 and may be mounted one above the other. The first and second inflatable border tubes 114A, 114B may provide a degree of buoyancy redundancy in that each border tube may be independently capable of supporting the weight of the life raft 100 when filled to capacity with passengers. The first inflatable border tube 114A may circumscribe the first side 111 of the base 110 and the second inflatable border tube 114B may circumscribe the second side 112 of the base 110. The multipurpose inflatable boarding deck 150 may be automatically inflated in response to deploying the life raft 100.

Multipurpose inflatable boarding deck 150 may be made from a fabric material, a plastic material, or a composite material, among others. For example, multipurpose inflatable boarding deck 150 may be made from nylon or a nylon material coated with a thermoplastic material, among others.

In various embodiments, and with continued reference to FIG. 1, the inflatable border tube 114A of the base 110 defines a first inflatable volume and the multipurpose inflatable boarding deck 150 defines a second inflatable volume. In various embodiments, the life raft 100 may include a charge cylinder 140 coupled to the one or more inflatable border tubes 114A, 114B, and the charge cylinder 140 may be configured to deliver air and/or other fluid into the one or more inflatable border tubes 114A, 114B and into the multipurpose inflatable boarding deck 150. For example, the first inflatable volume of the inflatable border tube 114A may be in fluidic communication with the second inflatable volume of the multipurpose inflatable boarding deck 150, and thus air/fluid delivered to the inflatable border tube 114A may flow from the first inflatable volume into the second inflatable volume of the multipurpose inflatable boarding deck 150.

In various embodiments, multipurpose inflatable boarding deck 150 may comprise an inflatable tube 152 at least partially circumscribing a platform 154 whereby a user may board life raft 100. In various embodiments, platform 154 may be made from a plastic sheet, or a webbing, among others. Platform 154 may be supported by inflatable tube 152. Multipurpose inflatable boarding deck 150 may comprise an inflation port 156 whereby inflatable tube 152 may be coupled to, and in fluidic communication with, base 110. In various embodiments, inflatable tube 152 may be coupled to, and in fluidic communication with, first inflatable border tube 114A. In various embodiments, inflatable tube 152 may be coupled to, and in fluidic communication with, second inflatable border tube 114B. In various embodiments, inflatable tube 152 may generally comprise a "U" shape.

In various embodiments, life raft 100 may include a first support strap 162 extending between inflatable tube 152 and first inflatable border tube 114A. Life raft 100 may include a second support strap 164 extending between inflatable tube 152 and first inflatable border tube 114A. Inflation port 156 may be disposed between first support strap 162 and second support strap 164. First support strap 162 and second support strap 164 may tend to prevent multipurpose inflatable boarding deck 150 from twisting about inflation port 156.

In various embodiments, life raft 100 may generally comprise a hexagonal shape. That is, first inflatable border tube 114A and second inflatable border tube 114B may define a hexagonal shape. However, life raft 100 may generally comprise a circular shape, a rectangular shape, a pentagonal shape, or an octagonal shape, among others.

With continued reference to FIG. 1, multipurpose inflatable boarding deck 150 is illustrated in the first position (also referred to herein as a boarding position) 190 whereby multipurpose inflatable boarding deck 150 may facilitate embarking. In the first position 190, inflation port 156 extends away from life raft 100. Multipurpose inflatable boarding deck 150, 152 may be deployed in the water in first position 190.

Figure 2:
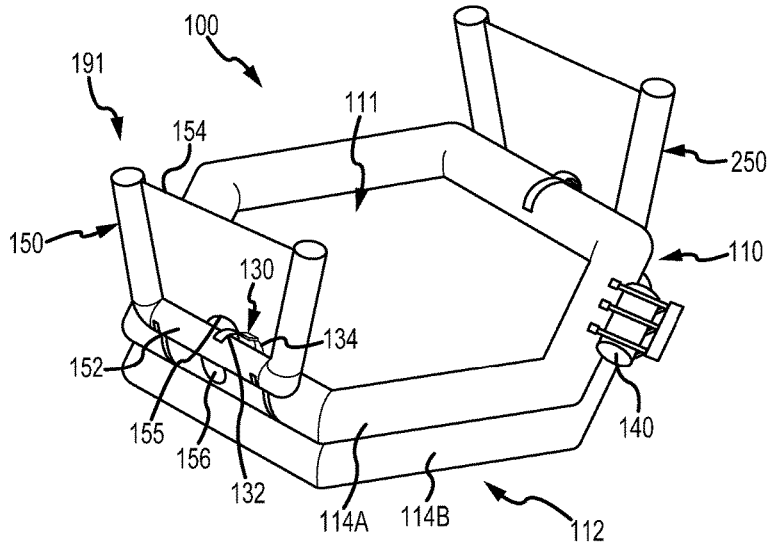
FIG. 2 is a perspective view of a life raft with a multipurpose inflatable boarding deck in a canopy position, in accordance with various embodiments.
Figure 4A:
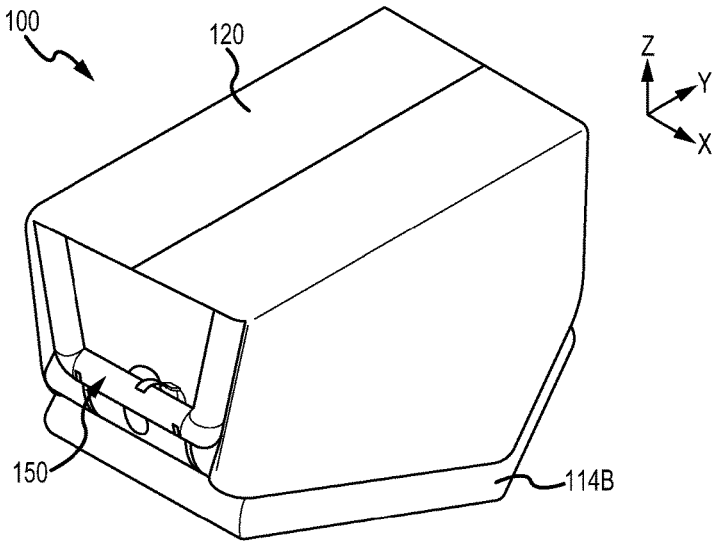
FIG. 4A and FIG. 4B are perspective views of the life raft of FIG. 2 with the multipurpose inflatable boarding decks supporting a canopy, in accordance with various embodiments.
Figure 4B:
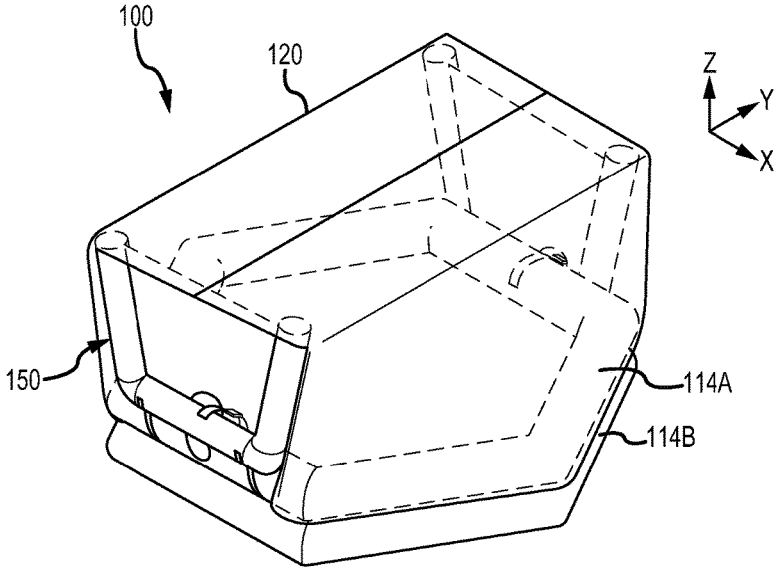
Figure 5:
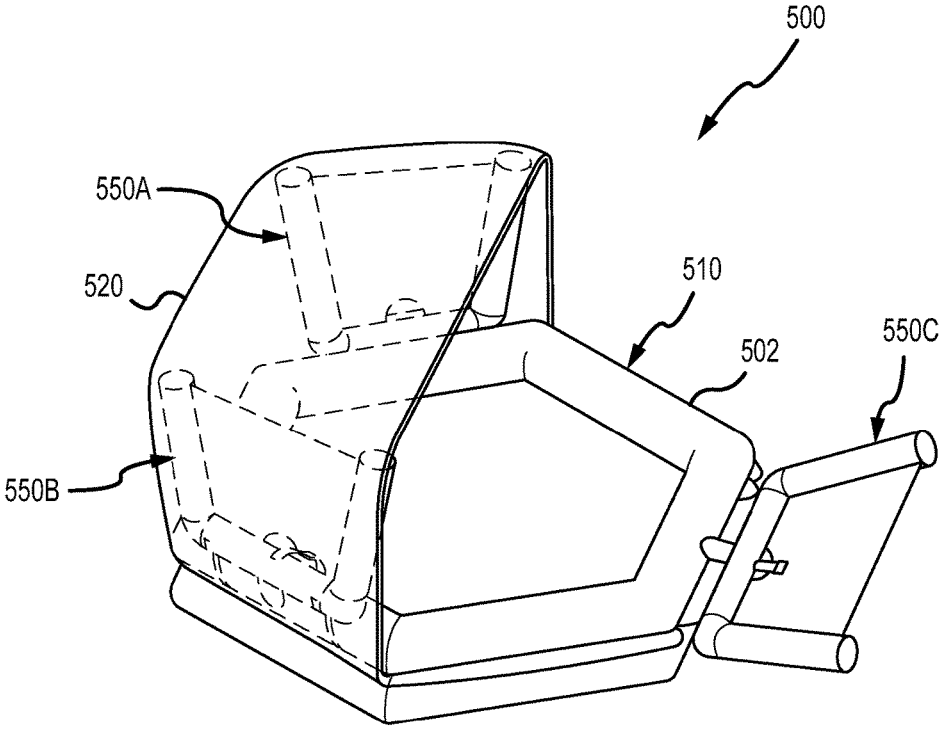
FIG. 5 is a perspective views of a life raft with two multipurpose inflatable boarding decks supporting a canopy and one multipurpose inflatable boarding deck in a boarding position, in accordance with various embodiments.

With reference to FIG. 2, multipurpose inflatable boarding deck 150 is illustrated in the second position (also referred to herein as a canopy position) 191 whereby multipurpose inflatable boarding deck 150 may support a canopy (e.g., see FIG. 4A through FIG. 5). In second position 191, multipurpose inflatable boarding deck 150 may be rotated towards life raft 100 and secured to base 110 with a fastening feature 130. Fastening feature 130 may comprise a first strap 132 coupled to multipurpose inflatable boarding deck 150 and a second strap 134 coupled to base 110. First strap 132 may be coupled to second strap 134, via a buckle or the like, to secure multipurpose inflatable boarding deck 150 in second position 191. In various embodiments, platform 154 may comprise an aperture 155 for accommodating first strap 132. Inflation port 156 may be secured in a bent position by fastening feature 130 in response to multipurpose inflatable boarding deck 150 being in second position 191. That is, inflation port 156 may bend in response to multipurpose inflatable boarding deck 150 moving from first position 190 to second position 191 to allow multipurpose inflatable boarding deck 150 to rotate about base 110. In this manner, multipurpose inflatable boarding deck 150 may extend vertically in second position 191. Stated differently, multipurpose inflatable boarding deck 150 may extend substantially perpendicular with respect to first side 111 in the second position 191. In various embodiments, inflatable tube 152 may contact first inflatable border tube 114A in response to being moved to second position 191. In various embodiments, inflatable tube 152 may be held in compression against first inflatable border tube 114A in response to being moved to second position 191.

In various embodiments, with continued reference to FIG. 2, life raft 100 may further include a second multipurpose inflatable boarding deck 250. Second multipurpose inflatable boarding deck 250 may be similar to multipurpose inflatable boarding deck 150. Second multipurpose inflatable boarding deck 250 may be disposed opposite life raft 100 from multipurpose inflatable boarding deck 150.

Figure 3:
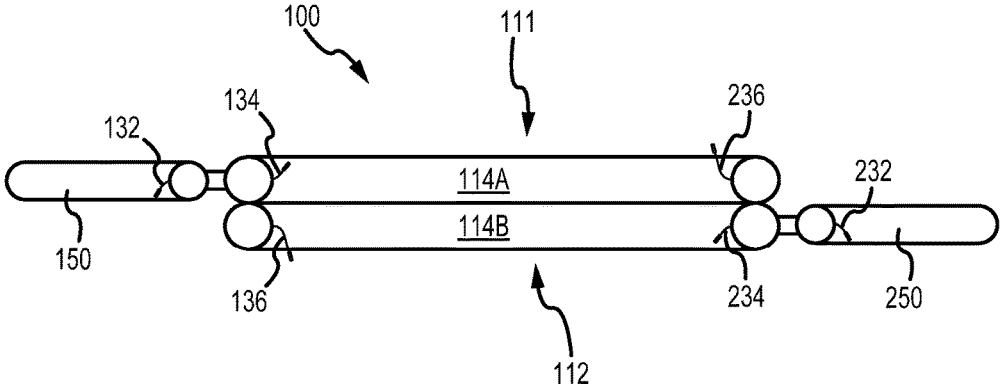
FIG. 3 is a cross-section view of the life raft of FIG. 1, in accordance with various embodiments.

With reference to FIG. 3, a cross-section view of life raft 100 is illustrated, in accordance with various embodiments. Multipurpose inflatable boarding deck 150 may be coupled to first inflatable border tube 114A, in accordance with various embodiments. In various embodiments, second multipurpose inflatable boarding deck 250 may be coupled to second inflatable border tube 114B. It is contemplated, however, that multipurpose inflatable boarding deck 150 and second multipurpose inflatable boarding deck 250 may both be coupled to either first inflatable border tube 114A or second inflatable border tube 114B. Second strap 134 may be coupled to first inflatable border tube 114A. A third strap 136 may be coupled to second inflatable border tube 114B. In this regard, in the event that first side 111 is facing a body of water, multipurpose inflatable boarding deck 150 may be rotated upwards (i.e., away from the body of water) towards second side 112 with first strap 132 secured to third strap 136. Furthermore, in the event that second side 112 is facing the body of water, multipurpose inflatable boarding deck 150 may be rotated upwards towards first side 111 with first strap 132 secured to second strap 134. That is, multipurpose inflatable boarding deck 150 may be deployable towards both first side 111 and second side 112, depending on the orientation of life raft 100. In various embodiments, first strap 132, second strap 134, and third strap 136 may be circumferentially aligned with each other.

Life raft 100 may further comprise a first strap 232, a second strap 234, and a third strap 236 for securing second multipurpose inflatable boarding deck 250 to either first inflatable border tube 114A or second inflatable border tube 114B, respectively.

With combined reference to FIG. 4A and FIG. 4B, life raft 100 is illustrated with a canopy 120 in the deployed position. Canopy 120 in FIG. 4B is illustrated as being transparent for clarity purposes. Canopy 120 may extend between base 110 and multipurpose inflatable boarding deck 150 and second multipurpose inflatable boarding deck 250. In this regard, canopy 120 may extend between multipurpose inflatable boarding deck 150 and second multipurpose inflatable boarding deck 250, whereby multipurpose inflatable boarding deck 150 and second multipurpose inflatable boarding deck 250 support canopy 120. Canopy 120 may be coupled to multipurpose inflatable boarding deck 150 and second multipurpose inflatable boarding deck 250 via any suitable attachment feature, including hook and loop fasteners, clasps, or buckles, among others. That is, in various embodiments, the canopy 120 may protect passengers from the sun, rain, weather conditions, and other elements.

The canopy 120 may be coupled between first inflatable border tube 114A and second inflatable border tube 114B for ease of deployment in response to either of first side 111 or second side 112 facing vertically upwards (positive Z-direction in FIG. 4A) when life raft 100 is in the water. For example, canopy 120 may be storable in a container coupled between first inflatable border tube 114A and second inflatable border tube 114B.

With reference to FIG. 5, a life raft 500 is illustrated having three multipurpose inflatable boarding decks (i.e., multipurpose inflatable boarding deck 550A, multipurpose inflatable boarding deck 550B, and multipurpose inflatable boarding deck 550C). Multipurpose inflatable boarding deck 550A, multipurpose inflatable boarding deck 550B, and multipurpose inflatable boarding deck 550C may be circumferentially spaced apart along the circumference 502 of base 510. Canopy 520 may be supported by multipurpose inflatable boarding deck 550A and multipurpose inflatable boarding deck 550B which may allow multipurpose inflatable boarding deck 550C to be used as a full-time boarding deck, without having to detach multipurpose inflatable boarding deck 550C from a canopy to be used as a boarding deck.

Figure 6A:
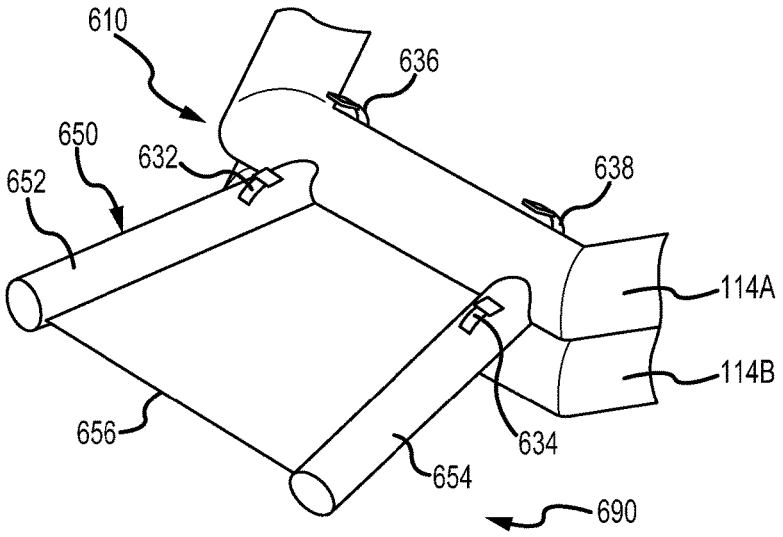
FIG. 6A is a perspective view a multipurpose inflatable boarding deck in a boarding position, in accordance with various embodiments.

With reference to FIG. 6A, a multipurpose inflatable boarding deck 650 is illustrated, in accordance with various embodiments. Multipurpose inflatable boarding deck 650 may comprise a first inflatable tube 652 extending from first inflatable border tube 114A and a second inflatable tube 654 extending from first inflatable border tube 114A. However, it is contemplated that, in various embodiments, both first inflatable tube 652 and second inflatable tube 654 may extend from second inflatable border tube 114B. First inflatable tube 652 and second inflatable tube 654 may be in fluidic communication with first inflatable border tube 114A. A platform 656 may be supported between first inflatable tube 652 and second inflatable tube 654. FIG. 6A illustrates multipurpose inflatable boarding deck 650 in a first position (also referred to herein as a boarding position) 690 whereby multipurpose inflatable boarding deck 650 may facilitate embarking.

Figure 6B:
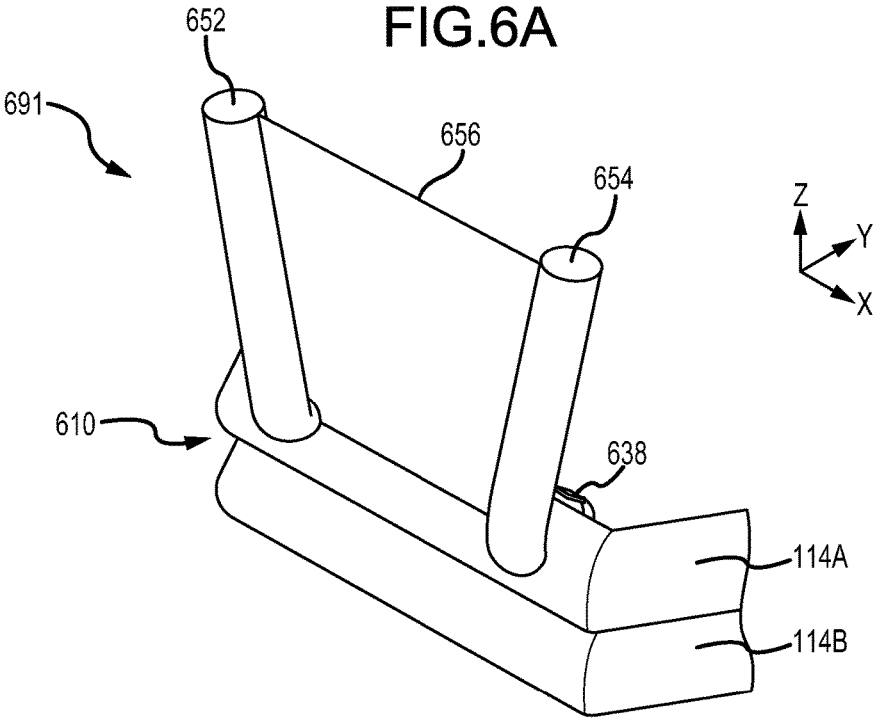
FIG. 6B is a perspective view of a multipurpose inflatable boarding deck in a canopy position, in accordance with various embodiments.

With reference to FIG. 6B, multipurpose inflatable boarding deck 650 is illustrated in the second position (also referred to herein as a canopy position) 691 whereby multipurpose inflatable boarding deck 650 may support a canopy. In second position 691, multipurpose inflatable boarding deck 650 may be rotated towards life raft 100 and secured to base 610 with one or more fastening features. For example, with combined reference to FIG. 6A and FIG. 6B, a first fastening feature 632 may be coupled to first inflatable tube 652 and a second fastening feature 636 may be coupled to base 610. First fastening feature 632 may be coupled to second fastening feature 636, via a buckle or the like, to secure multipurpose inflatable boarding deck 650 in second position 691. Similarly, a first fastening feature 634 may be coupled to second inflatable tube 654 and a second fastening feature 638 may be coupled to base 610. First fastening feature 634 may be coupled to second fastening feature 638, via a buckle or the like, to secure multipurpose inflatable boarding deck 650 in second position 691. Multipurpose inflatable boarding deck 650 may be rotated upwards into second position 691 causing first inflatable tube 652 to bend. In FIG. 6B, upwards is the positive Z-direction. However, depending on the orientation of the life raft, upwards may be in the negative Z-direction in accordance with various embodiments. First inflatable tube 652 may be held in said bent position via first fastening feature 632 and second fastening feature 636. Similarly, second inflatable tube 654 may be held in a bent position via first fastening feature 634 and second fastening feature 638 in response to multipurpose inflatable boarding deck 650 being moved to the second position 691. In this manner, multipurpose inflatable boarding deck 650 may extend vertically upwards (in the positive Z-direction) in second position 691. In various embodiments, fastening feature 632, fastening feature 634, fastening feature 636, and/or fastening feature 638, may be made from a webbing, for example, fabric webbing such as nylon webbing. In various embodiments, fastening feature 632, fastening feature 634, fastening feature 636, and/or fastening feature 638, may be a strap.

Figure 7:
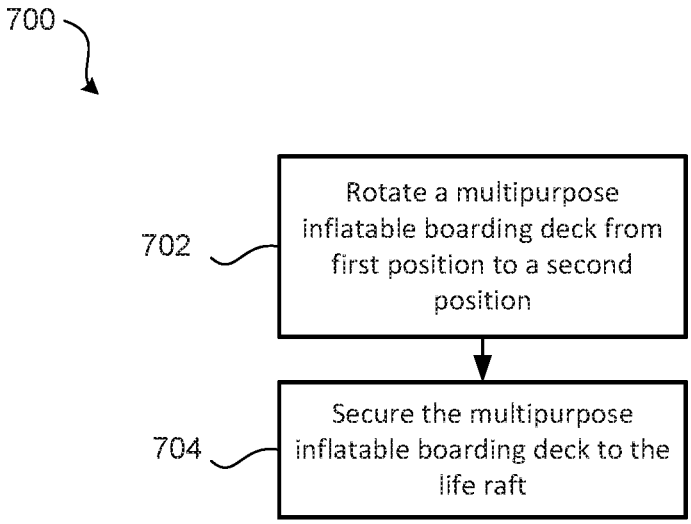
FIG. 7 is a schematic flow chart diagram of a method of using a life raft, in accordance with various embodiments.

In various embodiments, and with reference to FIG. 7 a method 700 of using a life raft is illustrated. Method 700 includes rotating a multipurpose boarding deck from a first position to a second position (step 702). Method 700 includes securing the multipurpose boarding deck to the life raft (step 704).

With combined reference to FIG. 1, FIG. 2, and FIG. 7, step 702 may include rotating multipurpose inflatable boarding deck 150 about first inflatable border tube 114A from first position 190 to second position 191. For example, a user may pull multipurpose inflatable boarding deck 150 to second position 191. Step 702 may include securing multipurpose inflatable boarding deck 150 to first inflatable border tube 114A using fastening feature 130.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure.

The scope of the disclosure is accordingly to be limited by nothing other than the appended claims, in which reference to an element in the singular is not intended to mean "one and only one" unless explicitly so stated, but rather "one or more." It is to be understood that unless specifically stated otherwise, references to "a," "an," and/or "the" may include one or more than one and that reference to an item in the singular may also include the item in the plural. All ranges and ratio limits disclosed herein may be combined.

Moreover, where a phrase similar to "at least one of A, B, and C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

The steps recited in any of the method or process descriptions may be executed in any order and are not necessarily limited to the order presented. Furthermore, any reference to singular includes plural embodiments, and any reference to more than one component or step may include a singular embodiment or step. Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

Any reference to attached, fixed, connected or the like may include permanent, removable, temporary, partial, full and/or any other possible attachment option. Additionally, any reference to without contact (or similar phrases) may also include reduced contact or minimal contact. Surface shading lines may be used throughout the figures to denote different parts or areas but not necessarily to denote the same or different materials. In some cases, reference coordinates may be specific to each figure.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A life raft comprising:

a base comprising a first side and a second side; and a multipurpose inflatable boarding deck coupled to the base and moveable between a first position whereby the multipurpose inflatable boarding deck facilitates embarking and a second position whereby the multipurpose inflatable boarding deck supports a canopy;

wherein the base defines a first inflatable volume;

the multipurpose inflatable boarding deck defines a second inflatable volume; and the first inflatable volume is in fluidic communication with the second inflatable volume.

2. The life raft of claim 1, wherein the base comprises an inflatable border tube defining the first inflatable volume.

3. The life raft of claim 2, further comprising an inflation port, whereby the multipurpose inflatable boarding deck is coupled to the inflatable border tube.

4. The life raft of claim 3, wherein the inflation port bends in response to the multipurpose inflatable boarding deck moving to the second position.

5. The life raft of claim 2, wherein the multipurpose inflatable boarding deck comprises:

a first inflatable tube extending from the inflatable border tube;

a second inflatable tube extending from the inflatable border tube; and a platform supported by the first inflatable tube and the second inflatable tube.

6. The life raft of claim 1, wherein the multipurpose inflatable boarding deck comprises:

an inflatable tube; and a platform supported by the inflatable tube.

7. The life raft of claim 1, further comprising a fastening feature configured to secure the multipurpose inflatable boarding deck in the second position.

8. The life raft of claim 7, wherein the fastening feature extends between the base and the multipurpose inflatable boarding deck in response to the multipurpose inflatable boarding deck being in the second position.

9. A life raft comprising:

a base comprising a first inflatable border tube defining a first inflatable volume, the base comprising a first side and a second side; and a first multipurpose inflatable boarding deck defining a second inflatable volume, the first multipurpose inflatable boarding deck coupled to the base and moveable between a first position whereby the first multipurpose inflatable boarding deck facilitates embarking and a second position whereby the first multipurpose inflatable boarding deck supports a canopy, wherein the first inflatable volume is in fluidic communication with the second inflatable volume.

10. The life raft of claim 9, further comprising a second multipurpose inflatable boarding deck.

11. The life raft of claim 10, further comprising a second inflatable border tube, wherein the second multipurpose inflatable boarding deck is coupled to the second inflatable border tube.

12. The life raft of claim 10, further comprising the canopy, wherein the canopy is configured to extend between the first multipurpose inflatable boarding deck and the second multipurpose inflatable boarding deck in response to the first multipurpose inflatable boarding deck and the second multipurpose inflatable boarding deck being in the second position.

13. The life raft of claim 9, wherein the first multipurpose inflatable boarding deck comprises:

an inflatable tube;

a platform supported by the inflatable tube; and an inflation port whereby the inflatable tube is coupled to the first inflatable border tube, wherein the inflation port is configured to bend in response to the first multipurpose inflatable boarding deck moving to the second position.

14. The life raft of claim 9, wherein the first multipurpose inflatable boarding deck comprises:

a first inflatable tube extending from the first inflatable border tube;

a second inflatable tube extending from the first inflatable border tube; and a platform supported by the first inflatable tube and the second inflatable tube.

15. The life raft of claim 9, further comprising a fastening feature configured to secure the first multipurpose inflatable boarding deck in the second position.

16. The life raft of claim 15, wherein the fastening feature extends between the base and the first multipurpose inflatable boarding deck in response to the first multipurpose inflatable boarding deck being in the second position.

17. A method of using a life raft, comprising:

rotating a multipurpose inflatable boarding deck about a base of the life raft from a first position to a second position; and securing the multipurpose inflatable boarding deck to the life raft in the second position;

wherein the base defines a first inflatable volume;

the multipurpose inflatable boarding deck defines a second inflatable volume; and the first inflatable volume is in fluidic communication with the second inflatable volume.

18. The method of claim 17, wherein the multipurpose inflatable boarding deck facilitates embarking in the first position, and the multipurpose inflatable boarding deck supports a canopy in the second position.

19. The method of claim 17, wherein:

the base comprises an inflatable border tube defining the first inflatable volume.

* * * * *